US009222722B2

(12) United States Patent
Kim et al.

(10) Patent No.: US 9,222,722 B2
(45) Date of Patent: Dec. 29, 2015

(54) REFRIGERATOR AND WATER TANK ASSEMBLY FOR REFRIGERATOR

(75) Inventors: Sungkyoung Kim, Changwon-si (KR); Jinil Hong, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 377 days.

(21) Appl. No.: 13/479,534

(22) Filed: May 24, 2012

(65) Prior Publication Data

US 2012/0297814 A1 Nov. 29, 2012

(30) Foreign Application Priority Data

May 25, 2011 (KR) ..... 10-2011-0049614

(51) Int. Cl.

| | |
|---|---|
| ***F25D 23/12*** | (2006.01) |
| ***F25D 3/00*** | (2006.01) |
| ***F25D 25/00*** | (2006.01) |
| ***F25C 5/18*** | (2006.01) |
| ***F25D 3/12*** | (2006.01) |
| ***F25C 5/00*** | (2006.01) |

(52) U.S. Cl.

CPC ..... *F25D 23/126* (2013.01); *F25C 5/005* (2013.01); *F25D 2323/122* (2013.01)

(58) Field of Classification Search

CPC ..... F25D 23/126; F25D 2323/122; F25D 2317/062; F25D 31/006; F25D 31/002; B67D 1/0857; F25C 5/005

USPC ..... 62/339, 377, 344, 390, 389; 138/30–31; 220/4.06, 4.07, 4.12, 4.13; 137/798; 251/144

See application file for complete search history.

(56) References Cited

U.S. PATENT DOCUMENTS 2,787,397 A * 4/1957 Radford ..... B65D 11/02 215/382
3,929,312 A * 12/1975 Uke ..... B63C 11/22 248/346.11
4,036,620 A * 7/1977 Benasutti ..... F25D 23/126 222/146.6
4,081,102 A * 3/1978 Sakai ..... 220/203.24
5,251,787 A * 10/1993 Simson ..... B67D 1/0462 222/105
5,290,442 A * 3/1994 Clack ..... 210/257.1
5,335,815 A * 8/1994 Josselyn ..... 220/560.03
5,339,863 A * 8/1994 Van Wie ..... F15B 13/0814 137/798
6,303,031 B1 * 10/2001 Senner ..... 210/232
6,991,362 B1 * 1/2006 Seaman ..... B01F 5/0218 239/240
7,000,984 B1 * 2/2006 Ward ..... A47C 31/113 297/188.2
8,097,157 B2 * 1/2012 Tubby ..... B01D 29/96 210/232
2003/0145527 A1 * 8/2003 Meyers ..... E02D 29/12 52/20
2004/0211717 A1 * 10/2004 Mitchell ..... B01D 35/153 210/235
2004/0252556 A1 * 12/2004 Taylor et al. ..... 365/189.05
2005/0173323 A1 * 8/2005 Meuleners et al. ..... 210/184
2006/0260349 A1 * 11/2006 Coulter et al. ..... 62/348
2007/0074527 A1 * 4/2007 Lee et al. ..... 62/344
2008/0047889 A1 * 2/2008 Huda ..... B01D 35/30 210/234
2009/0260583 A1 * 10/2009 Choi ..... F24H 1/181 122/19.2
2010/0229592 A1 * 9/2010 Lim ..... F25D 23/126 62/389
2011/0056222 A1 * 3/2011 Lee ..... F25D 23/126 62/129
2011/0126577 A1 * 6/2011 An ..... B29C 45/00 62/389

* cited by examiner

*Primary Examiner* — Cassey D Bauer
*Assistant Examiner* — Kirstin Oswald
(74) *Attorney, Agent, or Firm* — Ked & Associates, LLP

(57) ABSTRACT

A refrigerator and a water tank assembly for supplying water to an ice maker and a dispenser installed in a door of the refrigerator are provided. The water tank assembly may have a substantially cylindrical shape, and may include a water intake port, a water discharge port, and a switching valve all provided at one surface thereof to improve water storage space and facilitate connection of water lines.

16 Claims, 15 Drawing Sheets

REFRIGERATOR AND WATER TANK ASSEMBLY FOR REFRIGERATOR

CROSS-REFERENCE TO RELATED APPLICATION(S)

This application claims priority under 35 U.S.C. 119 to Korean Patent Application No. 10-2011-0049614 filed on May 25, 2011, whose entire disclosure is hereby incorporated by reference.

BACKGROUND

1. Field

This relates to a refrigerator and to a water tank assembly for a refrigerator.

2. Background

In general, refrigerators store items at low temperature using cool air. In a bottom freezer type refrigerator in which a refrigerating compartment is disposed above a freezing compartment, an ice maker and a water dispenser may be provided in a door of the refrigerator.

BRIEF DESCRIPTION OF THE DRAWINGS

The embodiments will be described in detail with reference to the following drawings in which like reference numerals refer to like elements wherein.

DETAILED DESCRIPTION

In a bottom freezer type refrigerator, a water tank may be provided in a door of the refrigerating compartment for temporarily storing water to be supplied to an ice maker and water dispenser provided in one of the doors of the refrigerator. The water tank may be provided as, for example, a supply hose wound a plurality of times and accommodated in a water tank receiving groove formed in a back surface of the refrigerating compartment door. Such a shape may consume a relatively large amount of storage space in the refrigerator while storing a relatively small amount of water. Such an arrangement may also result in freezing of residual water remaining in the water supply hose when water supply to the ice maker is stopped.

Figure 1:
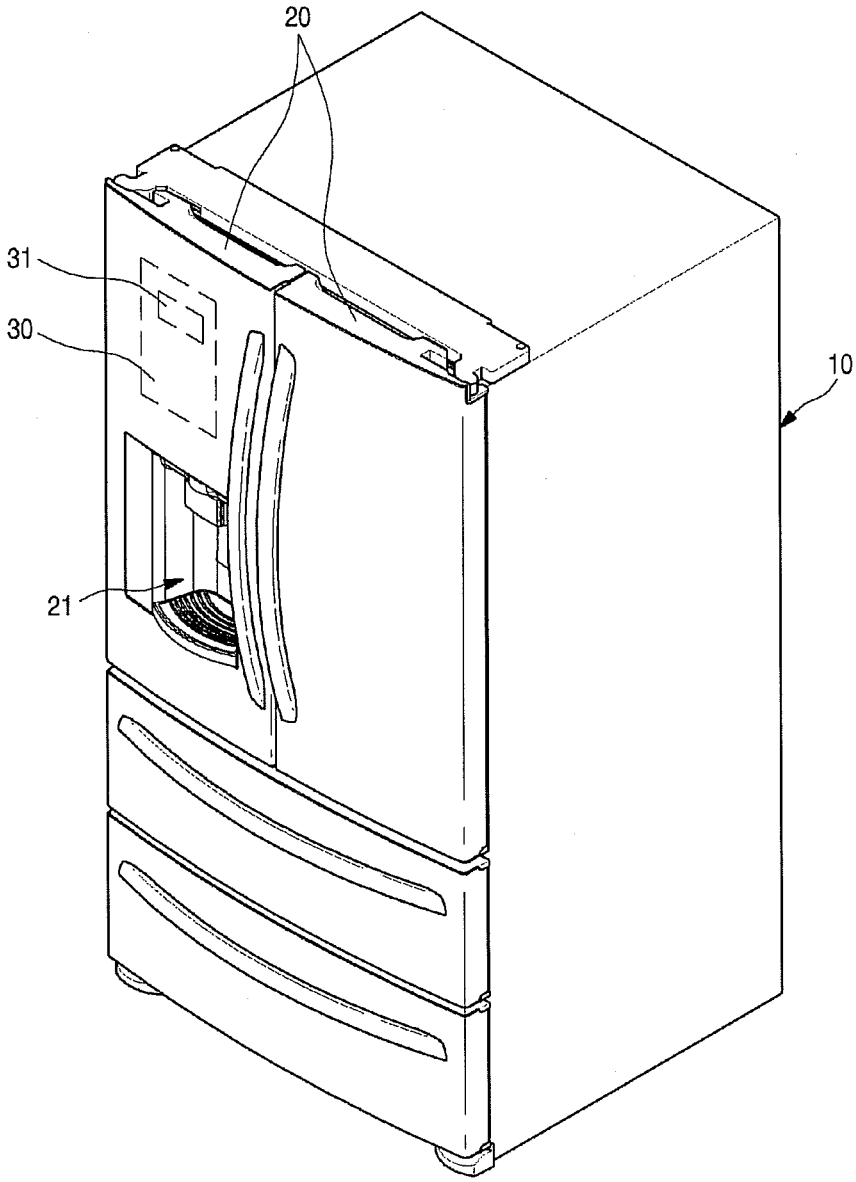
FIGS. 1 and 2 are perspective views of a refrigerator in accordance with an embodiment as broadly described herein.
Figure 2:
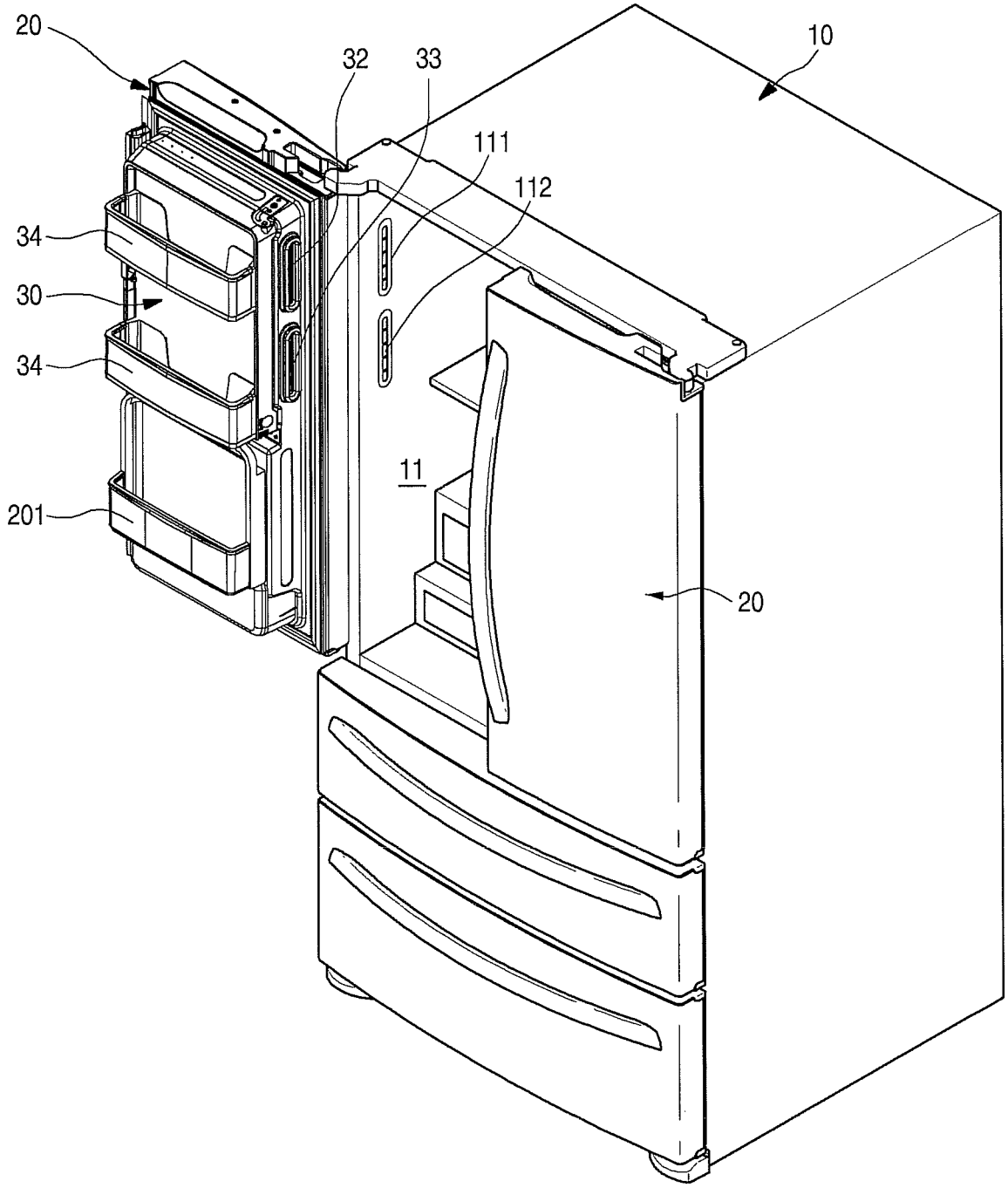
Figure 3:
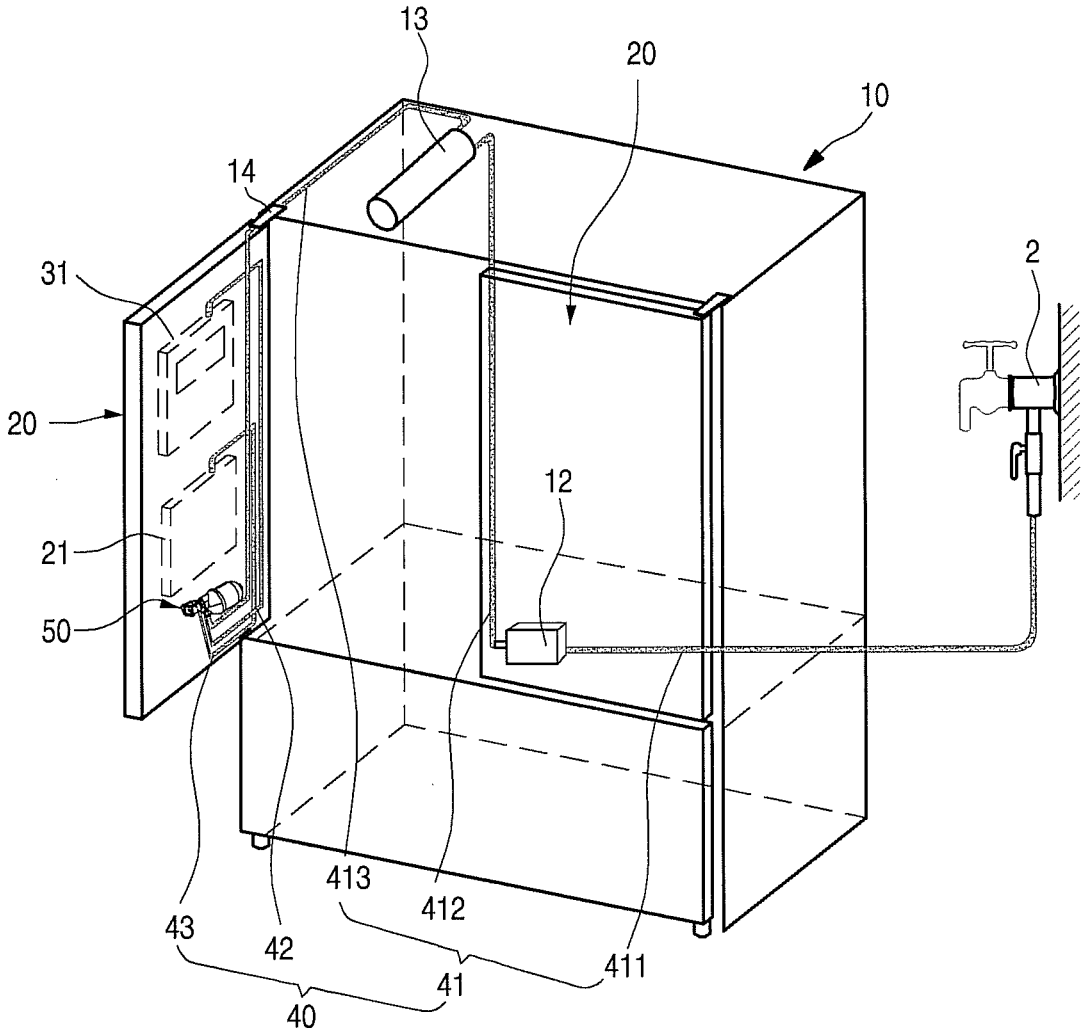
FIG. 3 is a schematic view of a connection state of a water supply passage of the refrigerator shown in FIGS. 1 and 2.

Referring to FIGS. 1 to 3, a refrigerator 1 in accordance with an embodiment as broadly described herein may include a main body 10 having a refrigerating compartment 11 and a freezing compartment, a refrigerating compartment door 20 for opening and closing the refrigerating compartment 11, and a freezing compartment door for opening and closing the freezing compartment.

Although not shown in detail, the freezing compartment may be defined under the refrigerating compartment 11 as a single space, or may be divided into a plurality of spaces by one or more partitions. A receiving box may be received in and slidably coupled in the freezing compartment. In more detail, a drawer may be provided in the freezing compartment, including a door for selectively covering a front opening of the freezing compartment, a door frame extending from a back surface of the door in a rear direction, a receiving box seated on the door frame, and a rail assembly allowing the door to slide in front and rear directions into and out of the freezer compartment.

The freezing compartment may be vertically or horizontally partitioned into a plurality of spaces by one more partitions. In the exemplary embodiment shown in FIGS. 1 and 2, the refrigerating compartment 11 and the freezing compartment are vertically partitioned by a horizontal partition and respectively covered by doors. In certain embodiments, one of the spaces partitioned within the freezing compartment may be used as a switching chamber which may selectively function in a refrigerating mode and a freezing mode.

A plurality of shelves and baskets may be disposed within the refrigerating compartment 11. The front opening of the refrigerating compartment 11 may be opened or closed by a pair of refrigerating compartment doors 20. The pair of refrigerating compartment doors 20 may be rotatably connected to left and right edges of the main body 10, respectively.

An ice making chamber 30 including a thermally insulated space for making and storing ice may be defined in a back surface of one of the refrigerating compartment doors 20. An ice maker 31 for making ice may be disposed within the ice making chamber 30. One or more racks 34 may be mounted on an outer surface of the ice making chamber 30. A cool air inlet hole 32 and a cool air outlet hole 33 may be defined in a side surface of the ice making chamber 30, such as, for example, a side surface of the ice making chamber 30 contacting an inner surface of the refrigerating compartment 11. A cool air supply hole 111 and a cool air recovery hole 112 may be defined in a side surface of the refrigerating compartment 11 respectively contacting the cool air inlet hole 32 and the cool air outlet hole 33 when the refrigerating compartment door 20 is closed. A cool air supply duct and a cool air return duct connecting the refrigerating compartment 11 to an evaporation chamber may be provided within a side surface of the refrigerating compartment 11.

One or more door baskets 201 may also be provided on a back surface of the refrigerating compartment door 20 corresponding to a lower side of the ice making chamber 30. These door baskets 201 may be similar to the racks 34 mounted on the outer surface of the ice making chamber. A water tank assembly 50 having a predetermined size may be provided in a space formed at a lower end of the back surface of the refrigerating compartment door 20.

A dispenser 21 for dispensing water and ice may be disposed in a front surface of the refrigerating compartment door 20, particularly, at a position corresponding to the ice making chamber 30 to dispense ice and water to the outside.

The ice maker 31 and the dispenser 21 may be connected to a water supply source 2 through a water supply passage 40 to receive water. The water supply passage 40 may include a water tank supply tube 41 connecting the water supply source 2 to the water tank assembly 50, an ice maker supply tube 42 connecting the water tank assembly 50 to the ice maker 31, and a dispenser supply tube 43 connecting the water tank assembly 50 to the dispenser 21. The water supply source 2 may be, for example, a faucet provided in the refrigerator or connected to the refrigerator, a water supply tank separately provided in the refrigerator, or other source as appropriate.

The water tank supply tube 41 may include a first supply tube 411, a second supply tube 412, and a third supply tube 413. The first supply tube 411 may connect the water supply source 2 to a water supply valve 12 disposed at a side of the main body 10. The second supply tube 412 may connect the water supply valve 12 to a purification filter 13 disposed within the refrigerator. The third supply tube 413 may connect the filter 13 to the water tank assembly 50.

Thus, water may be supplied from the water supply source 2 to the water tank assembly 50 via the water supply valve 12 and the filter 13. The third supply tube 413 may pass through a hinge 14 connecting the main body 10 to the refrigerating compartment door 20 to lead to the inside of the refrigerating compartment door 20. In certain embodiments, the third supply tube 413 may be two or more tubes connected to each other through a side of the hinge 14 or the main body 10.

The ice maker supply tube 42 and the dispenser supply tube 43 may be independently connected to the water tank assembly 50 inside the refrigerating compartment door 20. Also, the ice maker supply tube 42 and the dispenser supply tube 43 may be independently controlled to supply water into the dispenser 21 and the ice maker 31.

Figure 4:
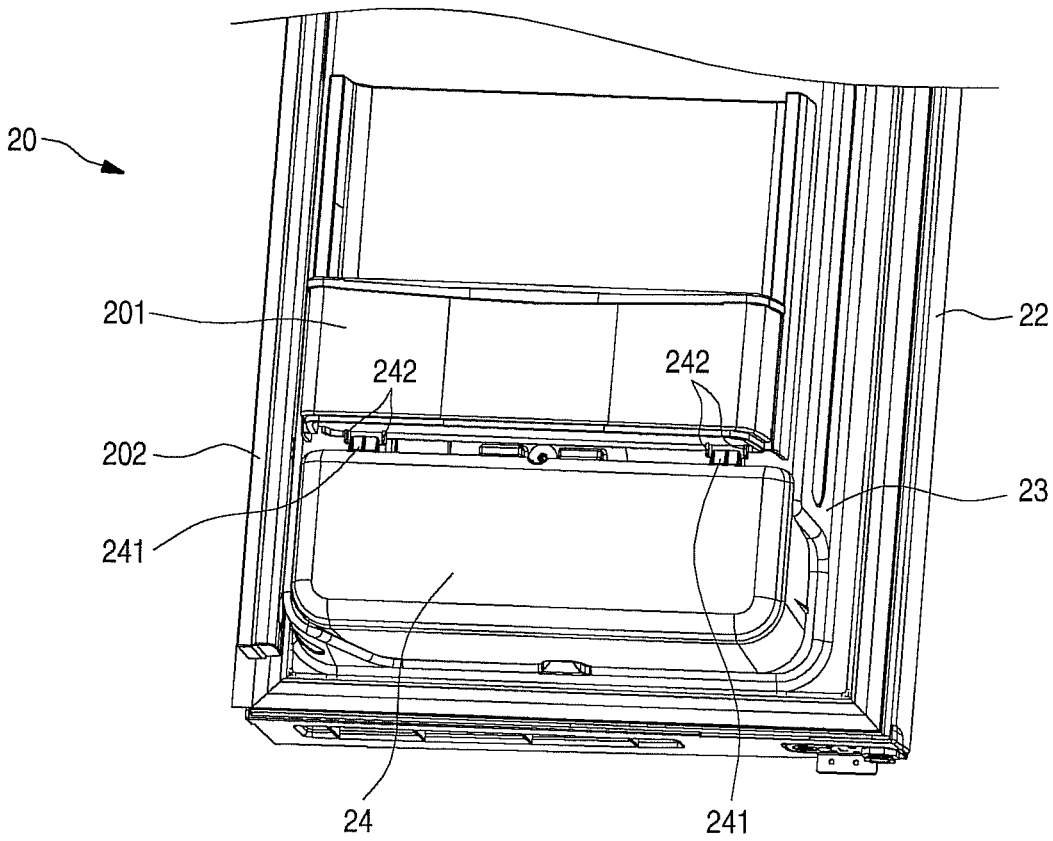
FIG. 4 is an enlarged rear perspective view of a refrigerating compartment door of the refrigerator shown in FIGS. 1 and 2.
Figure 5:
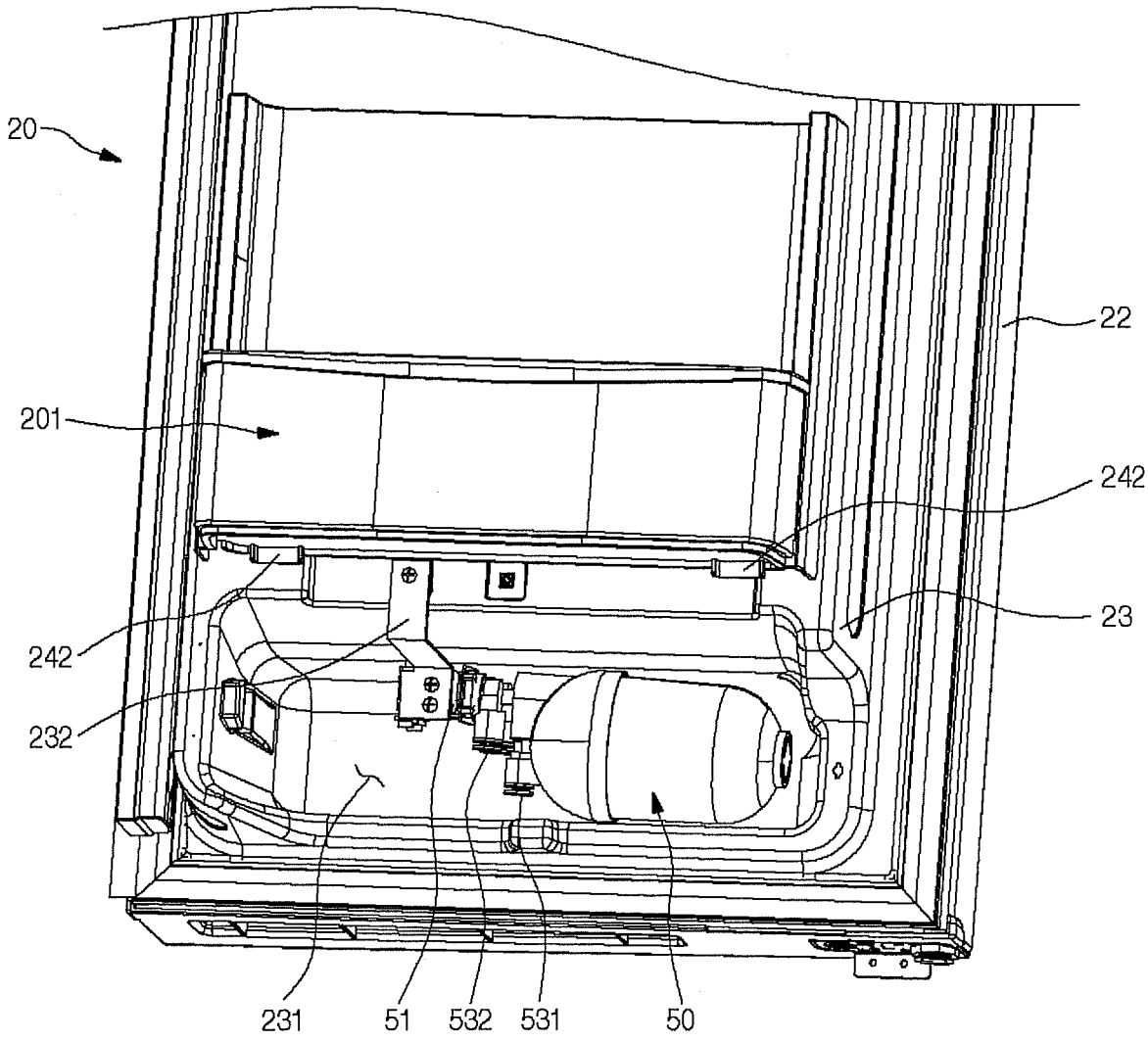
FIG. 5 is a rear perspective view of the refrigerating compartment door shown in FIG. 4, with a cover removed.
Figure 6:
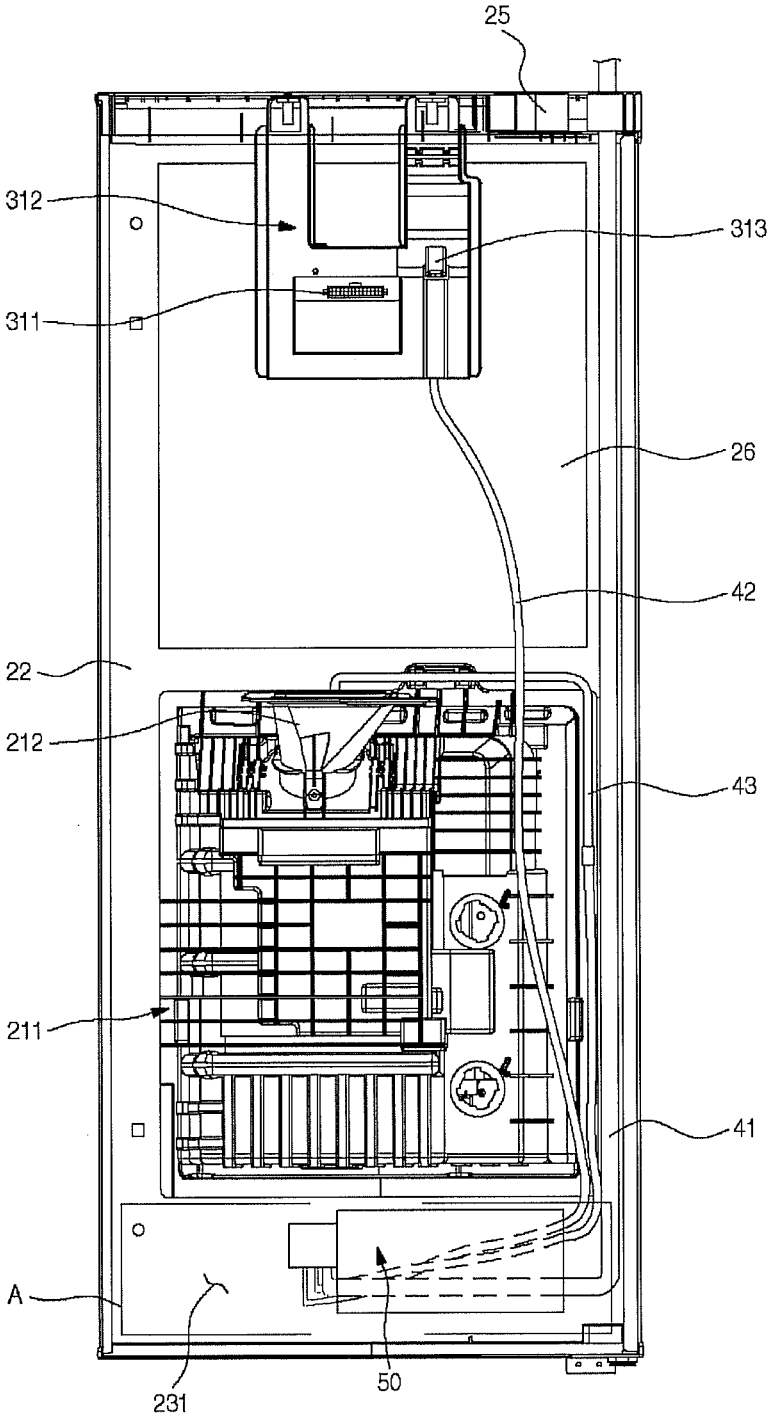
FIG. 6 illustrates a water tank assembly and a water supply passage installed in a refrigerator, in accordance with an embodiment as broadly described herein.

FIGS. 4 and 5 are rear perspective views of the refrigerating compartment door, and FIG. 6 illustrates the water tank assembly and the water supply passage mounted on the door, according to an embodiment as broadly described herein.

Referring to FIGS. 4 to 6, the refrigerating compartment door 20 may include an outer case 22 formed of, for example, a metal plate, and defining a front outer appearance thereof, and a door liner 23 coupled to a back surface of the outer case 22. An insulation material may be filled between the outer case 22 and the door liner 23.

In detail, a filler 202 for preventing cool air leakage may be provided on a side surface of the door liner 23, particularly, a side surface of the door liner 23 facing the adjacent door 20 when the pair of refrigerating compartment doors 20 are closed. The filler 202 may be closely attached to the side surface of the door liner 23 when the refrigerating compartment door 20 is opened as shown in the drawings. On the other hand, in a state where the refrigerating compartment door 20 is closed, the filler may be rotated, for example, at an angle of about 90°, to shield a boundary between one of the refrigerating compartment doors 20 and the other of the refrigerating compartment doors 20, thereby preventing cool air from leaking out of the refrigerating compartment 11 through a gap formed between the refrigerating compartment doors 20.

Referring to FIG. 4, a water storage unit may be provided on the back surface of the refrigerating compartment door 20. The water storage unit may include the water tank assembly 50 and a cover 24 preventing the water tank assembly 50 from being exposed to the outside.

The cover 24 may be detachably coupled to the back surface of the refrigerating compartment door 20. One or more hooks 241 may protrude from an upper end of the cover 24. One or more corresponding hook ribs 242 may extend from a lower end of the door basket 201. The hook 241 may be positioned behind the hook rib 242, so that the hook rib 242 is positioned between the door liner 23 and the hook 241 to prevent the door basket 201 from being inadvertently separated from the back surface of the refrigerating compartment door 20.

Hereinafter, a structure of a water storage unit in accordance with an embodiment will be described in detail with reference to the accompanying drawings.

Referring to FIGS. 5 and 6, the water storage unit may include the cover 24, a water tank mounting recess 231 covered by the cover 24 and recessed by a predetermined depth in a lower end of the back surface of the refrigerating compartment door 20, the water tank assembly 50 mounted in the water tank mounting recess 231 to store water supplied from the water supply source 2, and a switching valve 51 coupled to the water tank assembly 50 to direct a flow of the water to the dispenser 21 and the ice maker 31.

In detail, in certain embodiments a lower portion of the door liner 23 may be recessed by a predetermined depth toward the outer case 22 to form the water tank mounting recess 231. The water supply passage 40 connected to the water tank assembly 50 is removably provided in an inner wall of the water tank mounting recess 231. The water tank assembly 50 to which the switching valve 51 is coupled may be received into an inner space of the water tank mounting recess 231 and fixed in place by a fixing bracket 232.

The water tank assembly 50 may have, for example, a substantially tubular shape with a predetermined volume. In this embodiment, the water tank assembly 50 has a hollow cylindrical shape. Other shapes may also be appropriate. The ice maker supply tube 42 and the dispenser supply tube 43 of the water supply passage 40 may be connected to a side of the water tank assembly 50 at which the switching valve 51 is coupled. The water tank supply tube 41 may be connected below the ice maker supply tube 42 and the dispenser supply tube 43 to store and supply water in the water tank assembly 50.

Hereinafter, the water supply passage disposed within the refrigerator according to an embodiment will be described with reference to the accompanying drawings.

Referring to FIG. 6, the outer case 22 may be formed of, for example, a metal plate. A cap deco 25, or finishing cap 25, may be formed of, for example, a plastic material or other material as appropriate and mounted on an upper end of the outer case 22. The cap 25 may have a through-hole formed in a side thereof so that the hinge 14 may be disposed in the through-hole. The hinge 14 may have a hollow shape. Thus, as shown in FIG. 6, the water tank supply tube 41 may be introduced into the refrigerating compartment door 20 and extend downward. The water tank supply tube 41 may extend up to the water tank mounting recess 231 and pass through the door liner 23. Then, the water tank supply tube 41 may be connected to a water intake port 531 of the water tank assembly 50. In FIG. 6, an area A represents an area of the door 20 at which the water tank mounting recess 231 of the door liner 23 may be provided. The ice maker supply tube 42 and the dispenser supply tube 43 connected to a water discharge port 532 of the water tank assembly 50 may extend upward along a back surface of the outer case 22.

A receptacle 311 connected to a board for controlling the ice maker 31 and a holder 312 supporting a water supply faucet 313 for discharging water into the ice maker 31 may be provided on an upper portion of the back surface of the outer case 22. The holder 312 may be fixed to the cap 25. Also, the holder 312 may be attached to an insulation panel 26, such as, for example, a vacuum insulation panel, on the back surface of the outer case 22 corresponding to a front surface of the ice making chamber 30. The insulation panel 26 may be positioned between the outer case 22 and the holder 312. A recessed dispenser housing 211 may be mounted on the back surface of the outer case 22 to receive a container that receives ice and/or water dispensed by the dispenser 21. An ice chute 212 for guiding ice made in the ice making chamber 30 to the outside of the refrigerating compartment door 20 may be disposed on an upper end of the dispenser housing 211. A faucet for dispensing water may be provided at a front side of the ice chute 212.

In a refrigerator having the above-described structure, the dispenser supply tube 43 extends upward and is connected to the faucet provided at the dispenser 21. The ice maker supply tube 42 extends further upward than the dispenser supply tube 43.

Hereinafter, a structure of the water tank assembly will be described in detail with reference to the accompanying drawings.

Figure 7:
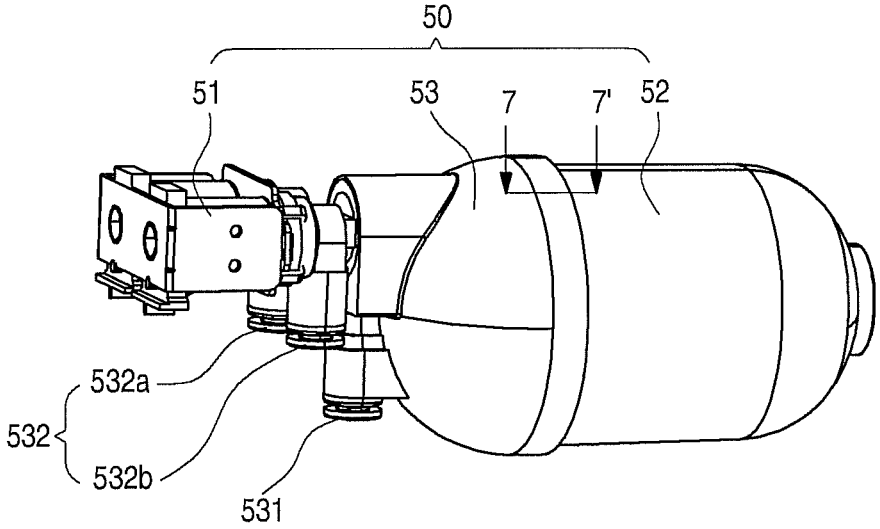
FIG. 7 is a perspective view of the water tank assembly shown in FIG. 6.
Figure 8:
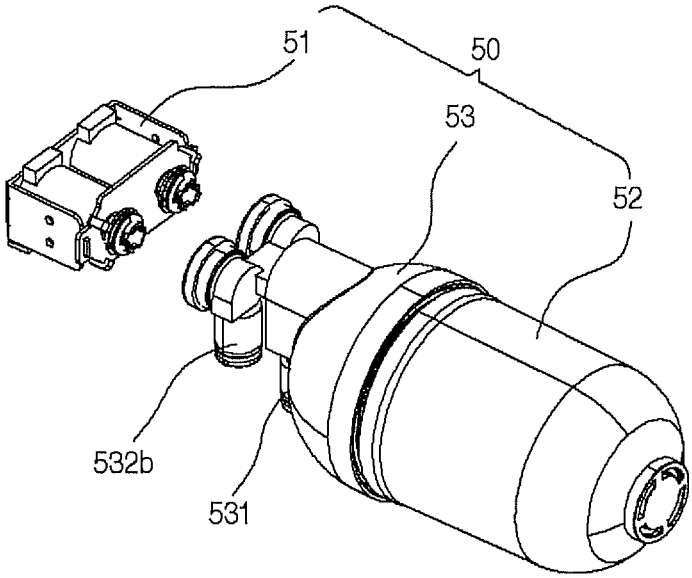
FIG. 8 is an exploded perspective view of the water tank assembly shown in FIGS. 6 and 7, in which a switching valve is separated.
Figure 9:
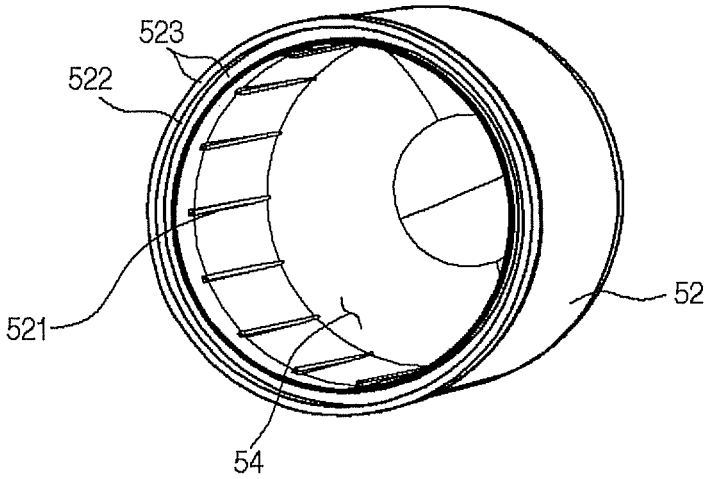
FIG. 9 is a perspective view of a tank body.
Figure 10:
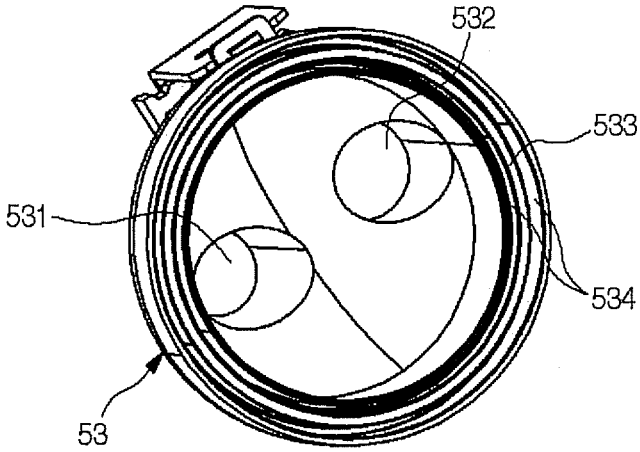
FIG. 10 is a perspective view of a tank cover.
Figure 11:
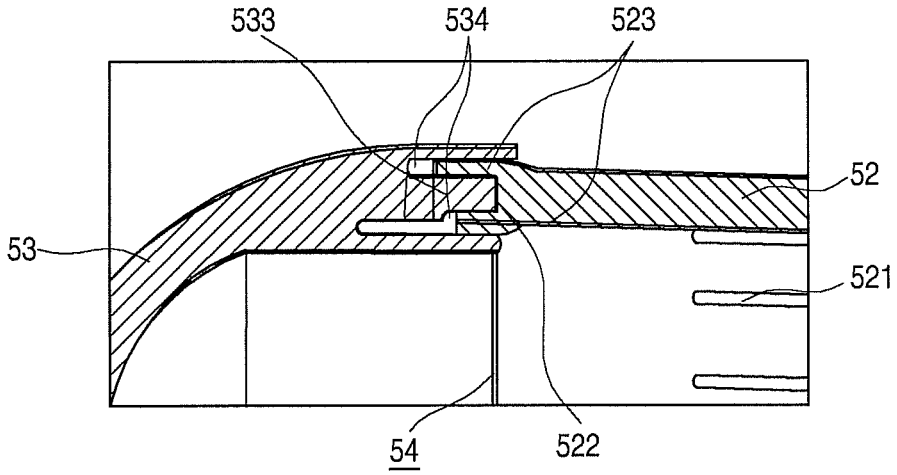
FIG. 11 is a sectional view taken along line 7-7' of FIG. 7.

FIGS. 7 and 8 are perspective views of the water tank assembly, FIG. 9 is a perspective view of a tank body, FIG. 10 is a perspective view of a tank cover, and FIG. 11 is a sectional view taken along line 7-7' of FIG. 7.

Referring to FIGS. 7 and 8, the water tank assembly 50 may have a hollow substantially cylindrical shape having a substantially circular cross section and forming a space in which water is received. The space for storing water may be defined by a tank body 52 and a tank cover 53. Alternatively, the space may have a pressure container shape with its two opposite ends having a hemispherical, or rounded, shape to support a pressure of supplied water.

The tank body 52 may have a hollow, substantially cylindrical shape with one end thereof being open and the opposite end thereof having a hemispherical shape, or rounded shape. The tank cover 53 may cover the opened end of the tank body 52 and have a hemispherical shape, or rounded shape. Thus, the tank body 52 and the tank cover 53 may be coupled to each other to form a shape such as a pressure container.

As discussed above, the water intake port 531 may be connected to the water tank supply tube 41 and the water discharge port 532 may be connected to the ice maker supply tube 42 and the dispenser supply tube 43. The intake and discharge ports 531 and 532 may be disposed on the tank cover 53. The switching valve 51 for selectively supplying water to the ice maker 31 and/or the dispenser 21 may be provided on the water discharge port 532. The switching valve 51 may be, for example, a solenoid valve. The switching valve 51 may be mounted on the water discharge port 532 to constitute the water tank assembly 50 as one body.

As described above, the connection of the water supply passage 40 and the mounting of the switching valve 51 may be performed on the tank cover 53. The majority of space for storing water may be defined by the tank body 52.

As shown in FIG. 9, the tank body 52 may extend for a predetermined length from an opened end to a closed hemispherical or rounded end thereof defining a storage space 54.

A plurality of ribs 521 may be disposed on the inside of the tank body 52 to reinforce the strength of the water tank assembly 50. Each of the ribs 521 may extend in a longitudinal direction along the inner circumferential surface of the tank body 52, separated by a predetermined interval, and protrude by a predetermined height. One or more of the ribs 521 may extend from the opened end of the tank body 52 to a portion of the opposite end at which the rounded, or hemispherical, shape starts. Alternatively, the ribs 521 may extend up to an end of the rounded end of the tank body 52.

Thus, water may be supplied into the water tank assembly 50 through the intake port 531 and discharged from the water tank assembly 50 through the discharge port 532. Accordingly, when an internal pressure of the water tank assembly 50 is changed, the ribs 521 may prevent the water tank assembly 50 from being expanded or contracted, thus preventing the water tank assembly 50 from being deformed and damaged.

In certain embodiments, the ribs 521 may partition the inner space of the water tank assembly 50 so that water filled from a lower portion of the water tank assembly 50 may be successively discharged from an upper portion of the water tank assembly 50. That is, since the water received in each of the partitioned spaces is successively discharged, the sufficiently cooled water supplied into the water tank assembly 50 may be supplied into the ice maker 31 and/or the dispenser 21.

A recess 522 and extension(s) 523 for coupling the tank body 52 to the tank cover 53 may be provided at the opened end of the tank body 52. In detail, the recess 522 may be defined along an edge of the opened end of the tank body 52, and the extension(s) 523 may protrude along the inside and outside of the recess 522 so as to define the recess 522.

A coupling protrusion 533 of the tank cover 53 may be inserted into the recess 522, and the extension(s) 523 may be inserted into corresponding coupling recess(es) 534 of the tank cover 53. Thus, the end of the tank body 52 may be inserted into an end of the tank cover 53.

The tank body 52 and the tank cover 53 may be attached by, for example, spin welding and coupled to each other. When spin welding is performed, a configuration in which the end of the tank body 52 is inserted into the tank cover 53 may be provided to prevent foreign substances generated when the tank body 52 is coupled to the tank cover 53 from being introduced into the storage space 54 within the water tank assembly 50.

The tank cover 53 will be described in more detail with reference to FIG. 10. An open end of the tank cover 53 may have a shape corresponding to that of the opened end of the tank 52 so that the tank cover 53 covers the opened end of the tank body 52. The tank cover 53 may have a hemispherical, or rounded, shape so that the water tank assembly 50 may form a pressure container shape when the tank cover 53 is coupled to the tank body 52.

As described above, an opened end of the tank cover 53 may have a shape corresponding to that of the opened end of the tank body 52 so that the tank body 52 may be inserted into and coupled to the cover 53. Thus, the end of the tank cover 53 may have a thickness slightly greater than that of the end of the tank body 52 so that after the end of the tank body 52 is inserted, the end of the tank body 52 may not be exposed to the inside of the storage space 54 in which water is received.

In detail, the coupling protrusion 533 and the coupling recess(es) 534 are disposed on the open end of the tank cover 53. The coupling protrusion 533 protrudes along a center of the edge of the tank cover 53 defining the open end thereof, and may have a shape corresponding to that of the recess 522 formed in the tank body 52 so that the coupling protrusion 533 may be received in the recess 522 when the tank cover 53 is coupled to the tank body 52. The coupling recess(es) 534 may be formed as recesses at the inside and outside of the coupling protrusion 533 so as to respectively receive the extensions 523 of the tank body 52. Thus, when the tank body 52 and the tank cover 53 are coupled to each other, the end of the tank body 52 may be completely inserted into the end of the tank cover 53, and the end of the tank body 52 is not exposed to the outside or inside.

In this state, even though the tank body 52 and the tank cover 53 may be attached to each other by the spin welding process, foreign substances generated during the spin welding process may be prevented from being introduced into the storage space 54 defined by coupling the tank body 52 and the tank cover 53 to each other.

A hole communicating with the water intake port 531 and the water discharge port 532 may be formed in the tank body 52. Thus, water to be stored in the storage space 54 may be introduced through the water intake port 531, and the stored water may be discharged through the water discharge port 532.

The water intake port 531 and the water discharge port 532 may be disposed at one side surface of the tank cover 53. The water intake port 531 may be positioned slightly lower than the water discharge port 532 so that water may be immediately filled when the water stored in the storage space 54 is discharged to prevent air from accumulating in the storage space 54.

Each of the water intake port 531 and the water discharge port 532 may have an end extending downward so that the water intake port 531 and the water discharge port 532 may be easily connected to the water supply passage 40 and the water supply passage 40 may be easily attached or detached to/from the water intake port 531 and the water discharge port 532. Also, the water discharge port 532 may be disposed in a position that is laterally spaced apart from that of the water intake port 531 so that the water supply passage 40 may be easily connected and interference with the water supply passage 40 may be minimized.

The water discharge port 532 may be branched into a first water discharge port 532*a* for supplying water to the ice maker 31 and a second water discharge port 532*b* for supplying water to the dispenser 21. The first water discharge port 532*a* and the second water discharge port 532*b* may be positioned side by side at substantially the same height.

The switching valve 51 may be connected to the water discharge port 532, in particular, to each of the first and second water discharge ports 532*a* and 532*b* to selectively open or close the first and second water discharge ports 532*a* and 532*b*. Thus, water may be selectively supplied to the ice maker 31 and/or the dispenser 21 by the switching valve 51. For this, each of the first and second water discharge ports 532*a* and 532*b* may be laterally opened and connected to the switching valve 51. The opening and closing of each of the first and second water discharge ports 532*a* and 532*b* may be decided by the operation of the switching valve 51. Valves which can selectively open or close the first and second water discharge ports 532*a* and 532*b*, such as, for example, a solenoid valve, may be used as the switching valve 51.

Each of the first and second water discharge ports 532*a* and 532*b* may have an open end that is oriented downward so that the ice maker supply tube 42 and the dispenser supply tube 43 may be respectively connected to the opened lower ends thereof.

The water supply passage 40 may be easily connected to or separated from the water intake port 531 and the water discharge port 532. An internal structure of the water intake port 531 and a structure of the water supply passage 40 will be described in more detail with reference to the accompanying drawings. Since a connection structure between the water intake port 531 and the water supply passage 40 may be essentially the same as that between the water discharge port 532 and the water supply passage 40, only the structure of the water intake port 531 will be described to avoid duplicated descriptions thereof.

Figure 12:
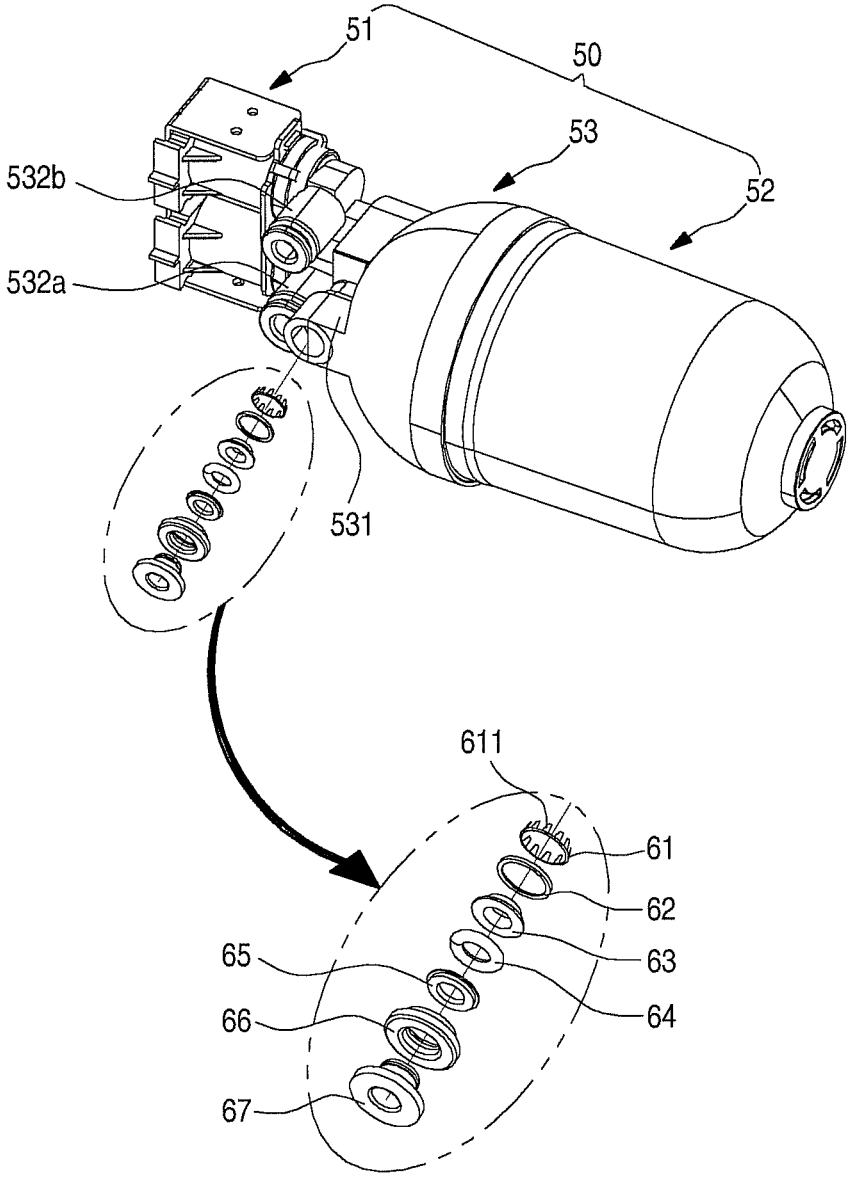
FIG. 12 is an exploded perspective view of a water intake port of a water tank assembly as embodied and broadly described herein.
Figure 13:
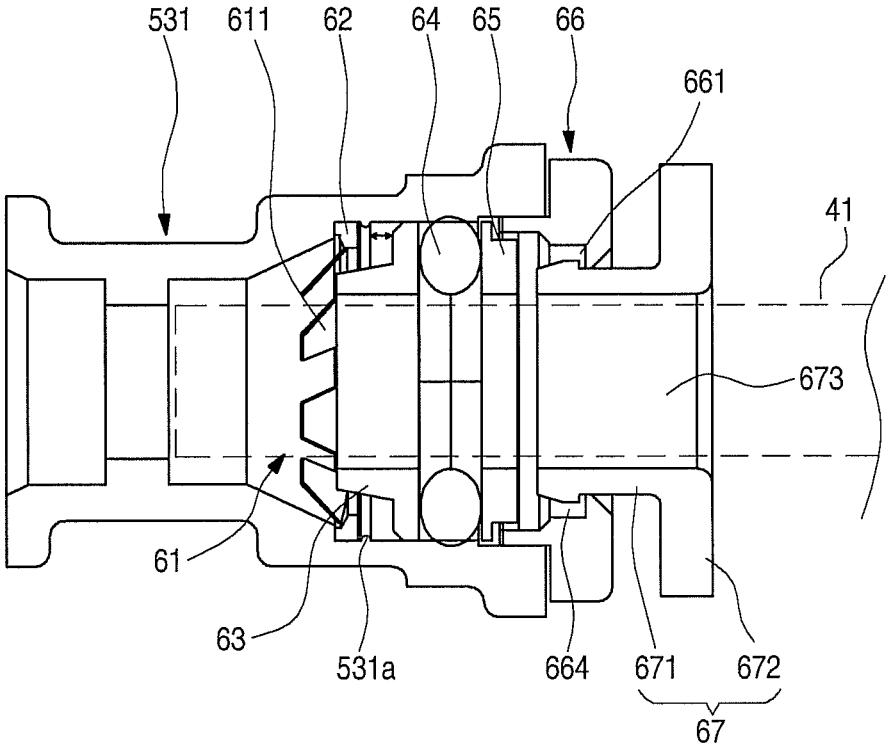
FIG. 13 is a sectional view of a water supply passage connected to the water tank assembly.
Figure 14:
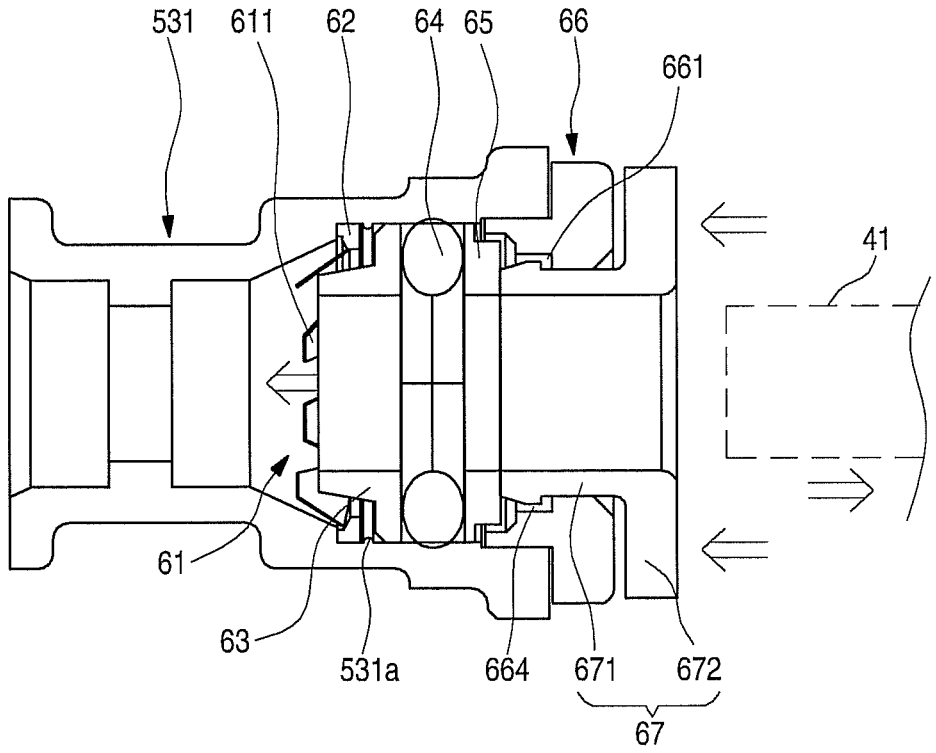
FIG. 14 is a sectional view of the water supply passage separated from the water tank assembly.

FIG. 12 is an exploded perspective view of the water intake port of the water tank assembly, FIG. 13 is a sectional view of the water supply passage connected to the water tank assembly, and FIG. 14 is a sectional view of the water supply passage separated from the water tank assembly.

Referring to FIGS. 12 to 14, the water tank supply tube 41 is inserted into and fixed to the inside of the water intake port 531. For this, a plurality of components may be disposed within the water intake port 531.

In detail, a lock ring 61 may be disposed inside the water intake part 531 to push on an outer circumference surface of the water tank supply tube 41 and fix a position the water tank supply tube 41. The lock ring 61 may have a circular ring shape with a plurality of restriction pieces 611, or teeth 611, extending at an incline along the inside of the lock ring 61. The restriction pieces 611 may have a saw tooth shape or trapezoid shape. The restriction pieces 611 may be formed of a material having elasticity or have a shape having elasticity. The restriction pieces 611 may be inclined inward to push on, or exert a force on and grasp, the outer circumferential surface of the water tank supply tube 41 when the water tank supply tube 41 is inserted. Thus, the restriction pieces 611 may fix the water tank supply tube 41 to prevent the water tank supply tube 41 from being unintentionally separated or moved in a reverse direction.

An outer circumference surface of the lock ring 61 may be fixed to the inside of the water intake port 531 by a fixing member 62 having a ring shape. A position of the fixing member 62 may be restricted by a hook protrusion 531*a* protruding from an inside of the water intake port 531.

A release ring 63 may be disposed under the lock ring 61. The release ring 63 may push the lock ring 61 to release the contact between the restriction pieces 611 of the lock ring 61 and the water tank supply tube 41 for removal of the water tank supply tube 41 from the water intake port 531. The release ring 63 may be disposed under the lock ring 61 so that the release ring 63 is vertically movable.

An O-ring 64 may be disposed under the release ring 63 and closely attached to the outer circumferential surface of the water tank supply tube 41 to prevent water from leaking. The water tank supply tube 41 may pass through the O-ring 64. The O-ring 64 may be formed of an elastic material so that the O-ring 64 is deformed when pressed. Also, the O-ring 64 may be movable by a predetermined distance through manipulation.

A snap ring 65 may be positioned under the O-ring 64 to prevent to prevent separation of the O-ring 64. The snap ring 65 may be movably mounted inside the water intake port 531. The snap ring 65 may have a stepped outer circumferential surface. Thus, a stepped portion of a plug 66 may be engaged with the stepped outer circumferential surface of the snap ring 65 to prevent the snap ring 65 from being separated. The snap ring 65 may have a predetermined width so that, when a manipulation member 67 is mounted, the snap ring 65 may contact an end of the manipulation member 67.

The plug 66 may be disposed under the snap ring 65 and inserted into the opened outside of the water intake port 531, with an end of the plug 66 exposed to the outside of the water intake port 531. The end of the plug 66 may have a stepped portion to support the snap ring 65, thereby preventing separation of the snap ring 65. A hook part 661 having a stepped portion may be provided at an inner surface of the plug 66. Movement of the manipulation member 67 may be restricted by the hook part 661.

The manipulation member 67 may be manipulated for separating the water supply passage 40 from the port 531. The manipulation member 67 may include an insertion part 671 and a manipulation part 672. The insertion part 671 may have a cylindrical shape which is inserted into the plug 66. The manipulation part 672 may be bent outward from an end of the insertion part 671 and exposed to the outside of the water intake port 531. An insertion hole 673 may be defined in the insertion part 671. The water supply passage 40 may pass through the insertion hole 673. A hook 664 may be engaged by the hook part 661 of the plug 66. Thus, the manipulation member 67 may be movable in a state where the manipulation member 67 is inserted into the plug 66. The insertion part 671 may extend by a predetermined length so that, when the manipulation member 67 is pushed, the snap ring 65 may be movable upward.

A process in which the water tank supply tube 41 is connected to and separated from the water intake port 531 will now be described.

To connect the water tank supply tube 41 to the water intake port 531, the water tank supply tube 41 is inserted through the insertion hole 673 of the manipulation member 67. The water tank supply tube 41 successively passes through the plug 66, the snap ring 65, the O-ring 64, the release ring 63, and the lock ring 61 and is received in and fixed to the water intake port 531.

When the water tank supply tube 41 is completely inserted, as shown in FIG. 13, the restriction pieces 611 of the lock ring 61 may push on and fix the outer surface of the water tank supply tube 41. In this state, when the water tank supply tube 41 is pulled, the water tank supply tube 41 is hooked by the restriction pieces 611 to prevent the water tank supply tube 41 from being inadvertently separated.

To separate the water tank supply tube 41 connected to the water intake port 531, a user may push the manipulation member 67 to insert the manipulation member 67 into the plug 66, as shown in FIG. 14. In detail, when the manipulation member 67 is pushed, the insertion part 671 of the manipulation member 67 is moved upward (to the left in the view shown in FIG. 14), and thus, the insertion part 671 pushes the snap ring 65. When the snap ring 65 is moved, the O-ring 64 supported by the snap ring 65 may also be moved upward (i.e., to the left) or deformed to push the release ring 63, thereby moving the release ring 63 upward. When the release ring 63 is moved upward, the protruding end of the release ring 63 pushes the inside of the restriction pieces 611 of the lock ring 61, and the inclined restriction pieces 611 may be deformed outward. As a result, the restriction pieces 611 are moved away from the outer circumferential surface of the water tank supply tube 41. In this state, the water tank supply tube 41 may be removed/released from the inside of the water intake port 531. Thus, the water tank supply tube 41 may be stably separated without being damaged by the restriction pieces 611.

The first and second water discharge ports 532*a* and 532*b* may be respectively connected to the ice maker supply tube 42 and the dispenser supply tube 43. Here, a structure for connecting or separating the tubes 42/43 to/from the water discharge ports 532*a* and 532*b* is essentially the same as that for connecting or separating the water tank supply tube 41 to/from the water intake ports 531.

Hereinafter, a state in which water is supplied into the refrigerator according to an embodiment as broadly described herein will be described with reference to FIG. 15.

Figure 15:
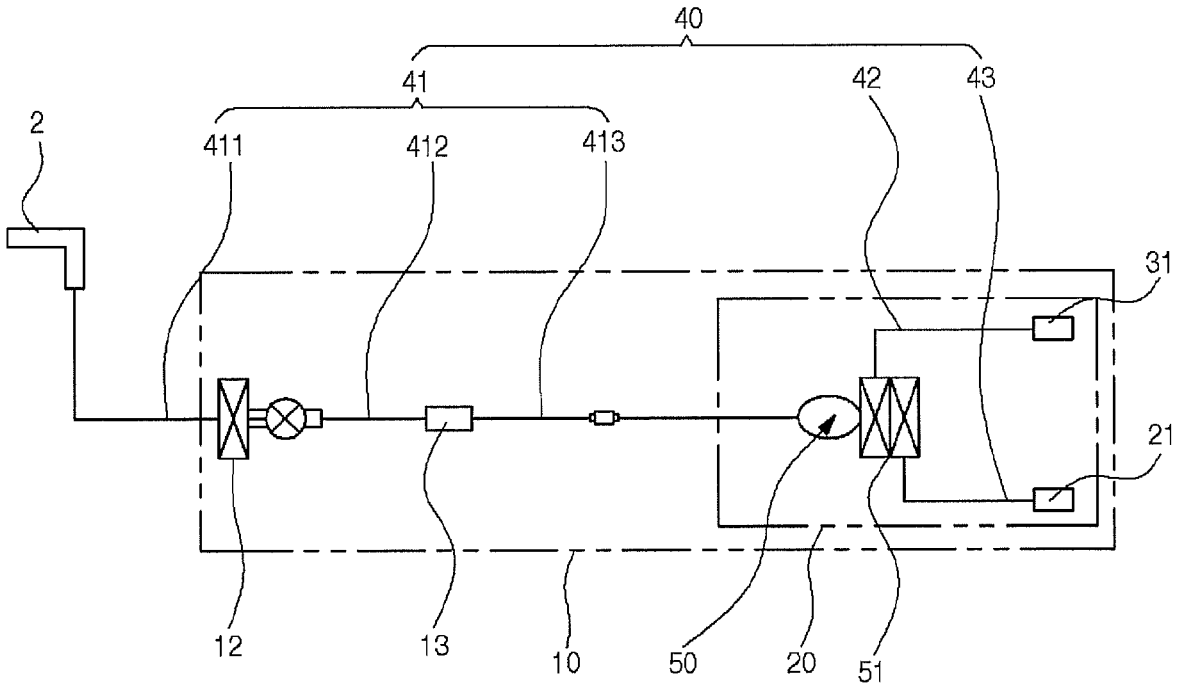
FIG. 15 is a schematic view of a water supply flow in a refrigerator as embodied and broadly described herein.

Referring to FIG. 15, water supplied from the water supply source 2 is supplied into the refrigerator through the first supply tube 411 toward the water supply valve 12. When the water supply valve 12 is opened, the water is supplied into the filter 13 along the second supply tube 412 and from the filter 13 to the water tank assembly 50 by the third supply tube 413. Here, the third supply tube 413 passes through the hinge 14 and is guided to the inside of the refrigerating compartment door 20. An end of the third supply tube 413 is connected to the water intake port 531 to supply water into the storage space 54 within the water tank assembly 50.

The water introduced through the water intake port 531 is filled into the storage space 54. The inside of the storage space 54 may be always filled with water by a pressure of the supplied water. In this state, when the user manipulates the dispenser 21 or a water supply signal is transmitted from the ice maker 31, the switching valve 51 is operated to supply water to the ice maker 31 and/or the dispenser 21.

To supply water to the ice maker 31, the first water discharge port 532*a* is opened by the switching valve 51 so that water stored in the storage space 54 may be supplied to the ice maker 31 through the ice maker supply tube 42 connected to the first discharge port 532*a*.

To supply water to the dispenser 21, the second water discharge port 532*b* is opened by the switching valve 51 so that water stored in the storage space 54 may be supplied to the dispenser 21 through the dispenser supply tube 43 connected to the second water discharge port 532*b*.

A water tank assembly as embodied and broadly described herein may have a cylindrical shape, and the water discharge port may be disposed above the water intake port, i.e., at an upper end of the side surface of the water tank assembly. Thus, since water may be fully stored within the water tank assembly without generating air, space efficiency may be maximized.

One or more reinforcing ribs may be provided within the water tank assembly to support a pressure of supplied water, thereby improving durability. Also, a plurality of reinforcing ribs may be arranged with a predetermined distance therebetween to partition the inner space of the water tank assembly so that stored water may be discharged in an inflow order.

A water tank assembly as embodied and broadly described herein may include the tank body and the tank cover. Also, the switching valve may be integrally provided on the tank cover, and the water supply passage may be directly connected to the tank cover. Thus, a complexity of the configuration of the water tank may be minimized. In addition, the tank body and the tank cover may be molten and attached to each other through a spin welding process to simply manufacture of the water tank assembly.

A switching valve for supplying water to the ice maker and/or the dispenser may be provided on the water discharge port of the water tank assembly to omit a water supply passage connecting the switching valve to the water tank assembly. Thus, when the water tank assembly is mounted, the number of assembly processes may be reduced, and the fitting number may be reduced to minimize possibility of water leakage at the fitting connection parts.

A water supply passage connected to the water intake port and the water discharge port of the water tank assembly may release contact between a lock ring and a water supply tube defining the water supply passage by the manipulation of a manipulation member to separate the water supply tube without being damaged.

A refrigerator and a water tank assembly for a refrigerator as embodied and broadly described herein may store a maximal amount of water in a limited inner space.

A refrigerator and a water tank assembly for a refrigerator as embodied and broadly described herein may be easily mounted by improving a shape of the water tank assembly and may easily connected to a water supply passage.

In one embodiment, a refrigerator as embodied and broadly described herein may include a main body defining a storage space; a door opening or closing the storage space; an ice maker disposed in the door to make ices; a dispenser disposed in the door to dispense water or ices to the outside; a water tank assembly disposed inside the door to store water to be supplied into the ice maker or the dispenser or supply water into the ice maker or the dispenser; and a water supply passage through which water within a water supply source is supplied into the ice maker or the dispenser via the water tank assembly, wherein the water tank assembly has a cylindrical shape and comprises a water intake part, through which water to be stored is supplied, and a water discharge part, through which the stored water is discharged, in the same side surface thereof, and a switching valve for deciding the water supply into the dispenser or the ice maker is disposed on the water discharge part.

In another embodiment, a water tank assembly for a refrigerator as embodied and broadly described herein may include a tank body having a cylindrical shape and an opened one side to receive water to be supplied; a tank cover coupled to the tank body to cover the opened one side of the tank body; at least one water discharge part disposed in an upper portion of the tank cover to discharge stored water; a water intake part disposed in a lower portion of the tank cover to supply water to be stored; and a switching valve provided at one side of the water discharge part to open or close the water discharge part.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body that defines a storage space;

a door that opens and closes the storage space;

a dispenser provided in the door to dispense ice and water;

an ice maker provided in the door and coupled to the dispenser to dispense ice;

a water tank assembly provided in a mounting recess formed in the door to store and selectively supply water to the ice maker and the dispenser; and a water supply passage that supplies water from a water supply source to the water tank assembly, wherein the water tank assembly comprises:

a tank comprising:

a substantially cylindrical tank body having a first end that is open and a second end that is closed; and a tank cover coupled to the first end of the tank body, wherein the second end of the tank body and the tank cover each has a hemispherical shape;

an intake port formed in the tank cover, wherein water is supplied into the tank through the intake port;

a pair of discharge ports formed in the tank cover and positioned higher than the intake port, wherein water is respectively discharged from the tank through the pair of discharge ports to the dispenser and the ice maker; and a switching valve directly mounted on the pair of discharge ports as one body, wherein the switching valve controls a flow of water to the dispenser and the ice maker, wherein the tank cover includes:

a coupling protrusion circumferentially formed along an open end of the tank cover;

an inner coupling recess circumferentially and circularly formed along the open end of the tank cover, wherein the inner coupling recess is configured to be positioned at an inner side of the coupling protrusion; and an outer coupling recess circumferentially and circularly formed along the open end of the tank cover, wherein the outer coupling recess is configured to be positioned at an outer side of the coupling protrusion, wherein the tank body includes:

an inner extension circumferentially formed along an inner side of the first end of the tank body;

an outer extension circumferentially formed along an outer side of the first end of the tank body; and a recess formed between the inner extension and the outer extension, and circumferentially formed along the first end of the tank body, and wherein when the end of the tank cover is coupled to the first end of the tank body, the coupling protrusion is inserted into the recess, the inner extension is inserted into the inner coupling recess, and the outer extension is inserted into the outer coupling recess, such that the tank body and the tank cover are attached to each other along edges of the open first end of the tank body and the open end the tank cover.

2. The refrigerator of claim 1, wherein the pair of discharge ports comprises:

a first discharge port connected to a dispenser supply tube through which water from the tank is supplied to the dispenser; and a second discharge port connected to an ice maker supply tube through which water from the tank is supplied to the ice maker, and wherein the first and second discharge ports are selectively opened and closed by the switching valve.

3. The refrigerator of claim 1, further comprising:

a water tank supply tube that connects the water supply source to the intake port of the water tank assembly, wherein the water tank supply tube passes through a hinge that rotatably couples the door to the main body to guide the water tank supply tube into the door.

4. The refrigerator of claim 1, wherein the mounting recess is formed in a back surface of the door that receives the water tank assembly therein, and wherein a cover is detachably coupled to the back surface of the door that covers the water tank assembly.

5. The refrigerator of claim 4, further comprising a bracket provided in the mounting recess to fix the water tank assembly in the mounting recess.

6. The refrigerator of claim 1, wherein the pair of discharge ports is positioned at an upper end of the tank cover.

7. The refrigerator of claim 1, wherein the water supply passage comprises:

a water tank supply tube that connects the intake port to the water supply source;

an ice maker supply tube that connects a first discharge port of the pair of discharge ports to the ice maker; and a dispenser supply tube that connects a second discharge port of the pair of discharge ports to the dispenser.

8. The refrigerator of claim 7, wherein the water tank supply tube comprises:

a first supply tube that connects the water supply source to a water supply valve provided at the main body;

a second supply tube that connects the water supply valve to a filter provided at the lain body; and a third supply tube that connects the filter to the tank.

9. The refrigerator of claim 7, wherein the water supply source is a faucet provided in the refrigerator or a water supply tank provided in the refrigerator to store water.

10. The refrigerator of claim 1, wherein the tank body further comprises a plurality of ribs that extends in a longitudinal direction from the open first end to the closed second end of the tank body, and wherein the plurality of ribs is spaced apart at a predetermined interval along a circumferential surface of the tank body.

11. The refrigerator of claim 1, further comprising a coupling assembly, provided in each of the pair of discharge ports and in the intake port, wherein the coupling assembly comprises:

a lock ring fixed and mounted within the respective port to exert a force on an outer circumferential surface of a water supply tube positioned in the respective port;

an O-ring positioned under the lock ring and closely attached to the outer circumferential surface of the water supply tube; and a release ring movably positioned between the lock ring and the O-ring to push the O-ring and release the force applied to the water supply tube by the lock ring.

12. The refrigerator of claim 11, Wherein the lock ring comprises a plurality of restriction pieces that protrudes at an incline from a circumferential portion of a ring thereof toward a center of the lock ring, and wherein the plurality of restriction pieces has a saw tooth shape and is spaced apart predetermined interval.

13. The refrigerator of claim 11, wherein the coupling assembly further comprises a manipulation member provided at an open end of the respective port, wherein the manipulation member includes an insertion hole formed therein, in which the water supply tube is received and guided into the respective port, and wherein the release ring moves in response to manipulation of the manipulation member to release the water supply tube.

14. The refrigerator of claim 10, wherein the plurality of ribs is disposed on an inner circumferential surface of the tank body.

15. The refrigerator of claim 10, wherein one or more of the plurality of ribs extends from the open first end to the closed second end of the tank body from a point where the hemispherical shape of the second end starts.

16. The refrigerator of claim 10, wherein the plurality of ribs protrudes a predetermined height from the circumferential surface of the tank body.

* * * * *